US009972296B2

(12) United States Patent
Steele

(10) Patent No.: US 9,972,296 B2
(45) **Date of Patent: *May 15, 2018**

(54) ACOUSTIC-TO-ELECTRONIC BASS DRUM CONVERSION KIT

(71) Applicant: Mark David Steele, New Smyrna Beach, FL (US)

(72) Inventor: Mark David Steele, New Smyrna Beach, FL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/405,385

(22) Filed: Jan. 13, 2017

(65) Prior Publication Data

US 2017/0125002 A1 May 4, 2017

Related U.S. Application Data

(63) Continuation-in-part of application No. 14/319,492, filed on Jun. 30, 2014, now Pat. No. 9,601,099.

(60) Provisional application No. 61/957,593, filed on Jul. 8, 2013.

(51) Int. Cl.

| | |
|---|---|
| ***G10H 1/00*** | (2006.01) |
| ***G10H 1/32*** | (2006.01) |
| ***G10H 3/00*** | (2006.01) |
| ***G10H 3/14*** | (2006.01) |
| ***G10D 13/02*** | (2006.01) |
| ***H04R 1/24*** | (2006.01) |
| ***G10H 1/34*** | (2006.01) |

(52) U.S. Cl.

CPC ..... *G10H 3/146* (2013.01); *G10D 13/024* (2013.01); *G10H 1/32* (2013.01); *G10H 1/348* (2013.01); *H04R 1/24* (2013.01); *G10H 3/143* (2013.01); *G10H 2230/291* (2013.01)

(58) Field of Classification Search

CPC ..... G10H 3/14; G10H 3/143; G10H 3/146; G10H 1/32; G10H 1/348; G10H 2230/291; G10H 1/00; G10H 3/00; G10D 13/024; H04R 1/24

USPC ..... 84/746, 723; 381/118

See application file for complete search history.

(56) References Cited

U.S. PATENT DOCUMENTS

| | | | |
|---|---|---|---|
| 3,553,339 | A | 1/1971 | Dominguez et al. |
| 3,638,753 | A | 2/1972 | Cunningham |
| 4,242,937 | A | 1/1981 | Pozar |
| 4,732,070 | A | 3/1988 | Yamashita |
| 4,819,536 | A | 4/1989 | Lombardi |
| 4,947,725 | A | 8/1990 | Nomura |
| 5,293,000 | A | 3/1994 | Adinolfi |

(Continued)

*Primary Examiner* — Vivian Chin
*Assistant Examiner* — Ubachukwu Odunukwe
(74) *Attorney, Agent, or Firm* — William C. Schrot; AuerbachSchrot LLC

(57) ABSTRACT

An acoustic-to-electronic bass drum conversion kit describes the parts needed to convert an acoustic bass drum into an electronic bass drum trigger and amplification device. My invention includes a front panel assembly which has at least one loudspeaker mounted on a panel which fits over the front of a bass drum shell, and a rear panel assembly which has an amplifier and an impact sensitive kick pad mounted on a rear panel. After discarding the front and rear drum heads and hoops, the front and rear panel assemblies are attached to the bass drum shell using conventional lug, tension rod and claw bracket technology. My invention provides the desired look of an acoustic bass drum for drummers who desire an electronic drum amplification system.

11 Claims, 22 Drawing Sheets

(56) References Cited

U.S. PATENT DOCUMENTS

| | | | | |
|---|---|---|---|---|
| 5,361,669 | A | 11/1994 | Genna | |
| 5,811,709 | A | 9/1998 | Adinolfi | |
| 6,075,197 | A | 6/2000 | Chan | |
| 6,121,528 | A | 9/2000 | May | |
| 6,201,173 | B1 | 3/2001 | Black | |
| 6,218,602 | B1 | 4/2001 | Davis | |
| 6,956,956 | B2 * | 10/2005 | Kuratani | H04R 1/02 381/345 |
| 6,982,376 | B2 | 1/2006 | Wise | |
| 7,030,305 | B1 | 4/2006 | Cupid | |
| 7,179,985 | B2 | 2/2007 | Pickens | |
| 7,282,633 | B1 * | 10/2007 | Coolidge | G10H 3/143 84/104 |
| 7,525,039 | B2 | 4/2009 | Steele | |
| 7,964,781 | B1 | 6/2011 | Lovvorn | |
| 8,170,259 | B2 | 5/2012 | Liu | |
| D681,105 | S | 4/2013 | Steele | |
| 8,481,832 | B2 | 7/2013 | Lloyd | |
| 8,916,761 | B2 | 12/2014 | Robertson | |
| 8,957,297 | B2 | 2/2015 | Urry | |
| 9,117,431 | B1 | 8/2015 | Rudes | |
| 9,124,967 | B2 | 9/2015 | Morton | |
| 2002/0062726 | A1 | 5/2002 | Abe | |
| 2003/0188629 | A1 | 10/2003 | Suenaga | |
| 2004/0025663 | A1 * | 2/2004 | Harada | G10D 13/024 84/104 |
| 2004/0211310 | A1 | 10/2004 | Hagiwara | |
| 2005/0022655 | A1 | 2/2005 | Wise | |
| 2005/0126378 | A1 | 6/2005 | Ludwig | |
| 2006/0021495 | A1 | 2/2006 | Freitas | |
| 2006/0064186 | A1 * | 3/2006 | Ryle | G10H 1/0091 700/94 |
| 2007/0221040 | A1 | 9/2007 | Bailey | |
| 2007/0234880 | A1 | 10/2007 | Adams | |
| 2009/0007763 | A1 * | 1/2009 | Steele | G10H 3/146 84/746 |
| 2010/0180750 | A1 | 7/2010 | Steele | |
| 2010/0242713 | A1 | 9/2010 | Prado | |
| 2010/0261513 | A1 | 10/2010 | Izen | |
| 2011/0056361 | A1 | 3/2011 | Steele | |
| 2011/0299238 | A1 | 12/2011 | Radin | |
| 2012/0006178 | A1 | 1/2012 | Steele | |
| 2012/0204704 | A1 | 8/2012 | Shim | |
| 2013/0152768 | A1 | 6/2013 | Rapp | |
| 2013/0180381 | A1 * | 7/2013 | Berndt | G10D 13/023 84/411 R |

* cited by examiner

ACOUSTIC-TO-ELECTRONIC BASS DRUM CONVERSION KIT

CROSS-REFERENCE TO RELATED APPLICATIONS

This application is a continuation-in-part of U.S. application Ser. No. 14/319,492, filed Jun. 30, 2014, which application is based on U.S. Provisional Application Ser. No. 61/957,593, filed Jul. 8, 2013, which disclosures of which are incorporated herein by reference in their entireties and to which priority is claimed.

FIELD OF THE INVENTION

The present invention relates to an acoustic-to-electronic bass drum conversion kit including a rear panel assembly securable to one end of an acoustic bass drum shell and having an amplifier and an impact sensitive drum trigger pad securable thereto, and a front panel assembly securable to the other end of the acoustic bass drum shell and having a speaker unit securable thereto.

BACKGROUND OF THE INVENTION

This invention relates generally to the field of musical instruments and more specifically to a complete system for an electronic bass drum.

Virtually every drum kit has a bass drum, whether it is an acoustic set or an electronic set. This invention is designed to replace current bass drums in every type of drum set.

In FIG. 1, a current technology acoustic drum set is presented, including a conventional acoustic bass drum. Note that there is the bass drum itself 21, a special bass drum microphone 22 and individual drum microphones 22*a* for picking up sounds when more volume is required, an amplifier/mixer or P.A. device 23 and speakers 24 to play the sounds to the audience. Also note that the pitch and voice quality of the bass drum always remain the same, and that the whole setup includes several components that are usually spread out and inaccessible to the drummer, most notably the volume control. Further, each component usually has its own heavy wooden case that adds to the weight and setup complexity of the system.

FIG. 1*a* shows the same drum kit, except for the acoustic bass drum which has been replaced by an embodiment of the present invention 25. Note that all of the peripheral amplification and sound equipment has also been replaced, by my single instrument. And because the invention includes an electronic drum module, the performer is able to control the voice quality of the bass drum at will, and all volume adjustment controls are readily available.

Current technology electronic drum sets FIG. 2, usually include a pedal 26, an impact sensitive electronic kick pad 27, a drum module 28 and an amplification system or P.A. 29 for performing. There are advantages to using an electronic drum set. The tonal quality of the drums is instantly variable; most modern drum modules offer over 500 different sounds, and these sounds are readily changeable depending upon the style of music played. Also, there is usually a volume control that is easily within reach of the drummer. However, existing technology drum sets still have drawbacks. An external amplification or P.A. system 29 still needs to be set up.

In FIG. 2*a*, the electronic bass drum 25 replaces the current kick pad, module, and amplification systems with a single, easily transportable instrument. Not only is my electronic bass drum used for an entire electronic drum set; an entire band can use the drum to play their music live or have a silent band practice.

Cosmetically, a large bass drum shape is very much desired by most drummers, and current electronic bass drum technology is shunned by most conventional acoustic drummers for this reason. And, there is no system for mounting tom-toms or other percussion instruments on the typical electronic bass drum. My invention overcomes some or all of the limitations of conventional systems.

The invention described herein is similar to the instrument that is described in my previous U.S. Pat. No. 7,525,039, but includes one or more additional features. In one embodiment, a system for mounting and protecting commercially available drum modules is provided, which includes a shock-proof mount which I have designed. This system makes it simpler for amplifier companies to manufacture the instrument, and it allows drummers to use their existing drum modules rather than purchase one that is incorporated into the shell. Special jacks allow drum modules to be used wherever they are mounted; either on my bass drum or in a remote location.

Also, a conversion apparatus or kit is disclosed that allows drummers or manufacturers to use conventional acoustic bass drums as the body for electronic drum amplifier systems.

SUMMARY OF THE INVENTION

Embodiments of the present invention offer acoustic drummers a bass drum with dozens of different sounds.

In some implementations, the bass drum has several acoustic drum microphone jacks readily available. In some implementations, an amplification and speaker system built into the shell of a single instrument is provided, thus eliminating the need for separate components. In some implementations, tom-tom and other mounting brackets incorporated into an electronic bass drum are provided. In some implementations, a mounting system for electronic pads is provided, that more closely resembles an acoustic set, thus eliminating bulky racks currently in use.

In some implementations, the disclosed bass drum is configured to allow drummers to attach and incorporate any type of drum module onto the instrument. In some implementations, the bass drum is configured to allow drummers to use drum modules that are not attached to the instrument.

In some implementations, a shock resistant mounting system is provided that protects mounted drum modules. In some implementations, sound level and drum tone change controls are provided, which are readily available to the drummer. In some implementations, the bass drum includes multiple input jacks, e.g. such as for the drum module for readily available connection thereto.

In some implementations, the bass drum apparatus is configured to allow other band members the capability of sharing the built-in amplification and speaker systems, so that the members are able to perform through the single apparatus. In some implementations, a headphone system is incorporated into the apparatus for a completely quiet band practice. In some implementations, the apparatus is configured to allow for the use of an MP3 player device for play-along practice and recording.

The present invention is also directed to an acoustic-to-electronic bass drum conversion kit, which is configured to allow drummers to quickly and easily convert their cylindrical acoustic bass drums into performance amplifier systems. In one embodiment, an acoustic-to-electronic bass drum conversion kit, comprises: a rear panel assembly including a rear panel securable to a first end of a bass drum shell, an amplifier securable to said rear panel, and an impact sensitive drum trigger pad securable to said rear panel; and a front panel assembly including a front panel securable to a second end of said bass drum shell, said second end opposite to said first end, and one or more speaker units securable to said front panel and electrically coupleable to said amplifier.

In some embodiments, the rear panel assembly and the front panel assembly of the conversion kit are securable to said bass drum shell via lugs, tension rods and claw brackets.

In some embodiments, the impact sensitive drum trigger pad is mounted to an impact dampening device, such as described herein. The impact dampening device is intermediate the impact sensitive drum trigger pad and the rear panel when the impact sensitive drum trigger pad is secured to the rear panel.

In some embodiments, the conversion kit includes a drum module mounting bracket securable to the rear panel. A drum module may also be provided, which is removably securable to the drum module mounting bracket.

In some embodiments, one or more input jacks are provided, which are electrically coupled to the amplifier of the conversion kit. External electronic device(s) may be connected to the input jack(s), so that such electronic devices are in communication with the amplifier.

In some embodiments, the conversion kit provides for an internal cooling fan disposable within an internal cavity of the bass drum shell. A bass drum pedal operably associated with the impact sensitive drum trigger pad may also be provided.

Additional features and advantages of embodiments of the present invention are apparent from the following descriptions and drawings.

BRIEF DESCRIPTION OF THE DRAWINGS

Exemplary embodiments and features of the present invention are illustrated in the drawings. It is to be understood that in some instances various aspects of the invention may be shown exaggerated or enlarged to facilitate an understanding of the invention.

DETAILED DESCRIPTION OF EMBODIMENTS OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 3:
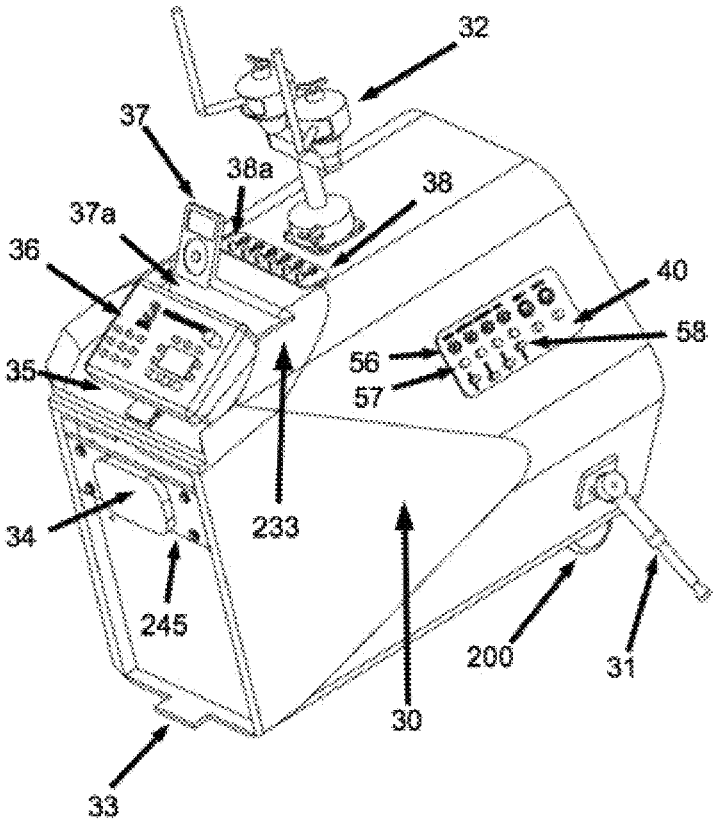
FIG. 3 is an overhead view from the right rear of an apparatus according to the present invention and including preferred features.

FIG. 3 gives an overview of preferred components of an electronic bass drum in accordance with an embodiment of the invention, wherein corresponding components in the various views shown in FIGS. 3-11 are designated by the same reference numerals. An outer shell 30 is used, and the external finish of said outer shell would probably match the other drums in each individual kit. The outer shell 30 may or may not be cylindrical. Stabilization legs 31 and tom-tom mounts 32 are designed for prior art acoustic bass drums and are useable in the invention as well. All other mounting hardware designed for mounting additional percussion instruments designed for conventional acoustic bass drums will work on this electronic bass drum. There is an attachment bracket 33 for mounting a bass drum pedal at the rear of the invention, and an impact sensitive electronic drum kick pad 34 is installed for striking with said bass drum pedal. A flexible mounting bracket for an electronic kick drum pad 245 helps to dampen the vibration created when a drum pedal strikes the pad. The electronic kick pad signal is sent to the drum module 36 that is mounted to the shell and makes up part of the control panel 35. There is an MP3 player 37 and receptacle 37*a* that allows the drummer to practice along with music, or to record practice sessions. There are several optional input jacks 38 for acoustic drummers that want input jacks for their drum microphones. Microphone volume adjustment controls 38*a* are shown. The auxiliary input panel 40 of FIG. 3 has several input jacks 56 that allow other performers to play their instruments through the internal amplifier of the invention. Each input to the amplifier has an input volume control 57. Built-in wheels 200 allow for easy transport. And an optional removable cowling 233 helps to conceal the drum module.

Figure 4:
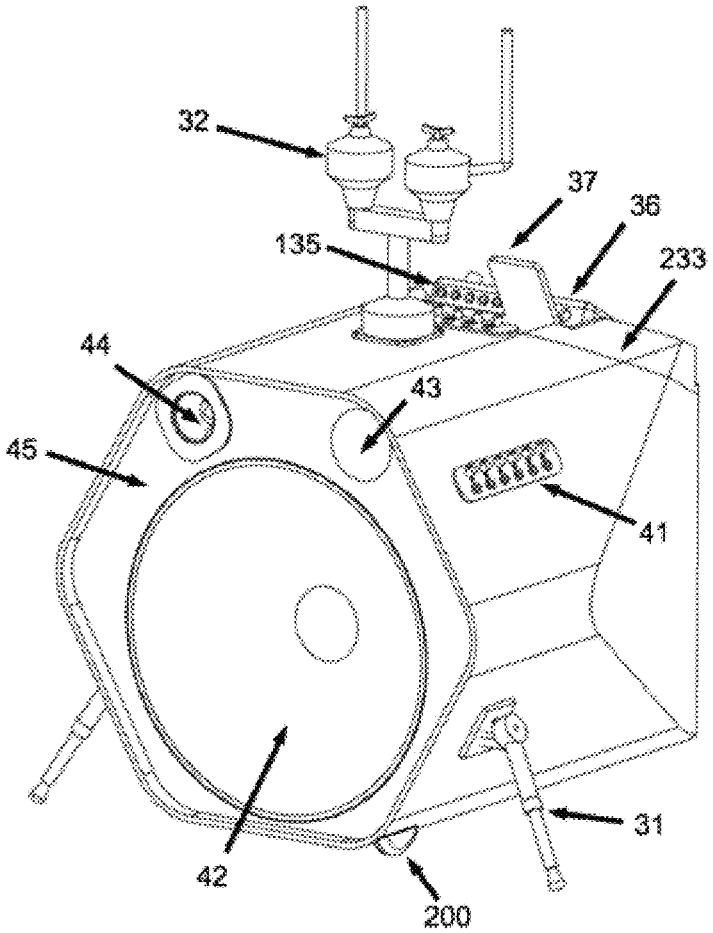
FIG. 4 is a front quarter view showing loudspeaker installation.

FIG. 4 shows the front end of the instrument, where one or more loudspeakers or drivers can be mounted in a variety of ways. In this embodiment, there is depicted a woofer 42, and a tweeter 44 all mounted to the forward wall 45. A vent 43 is shown for optimizing speaker performance. There is also an auxiliary headphone panel 41 that allows several band members to listen to the combined inputs to the internal amplifier, as well as the drum module 36 and MP3 player 37 as desired. Multiple electronic drum instruments can be plugged into the back of the drum module 36 using individual jacks 135 or a single multiple connector snake (not shown).

The electronic bass drum is designed so that an entire band can plug into the invention and practice together silently through headphones, or perform together through the integrated amplifier and speaker system. An optional cosmetic cowling 233 is shown.

Figure 5:
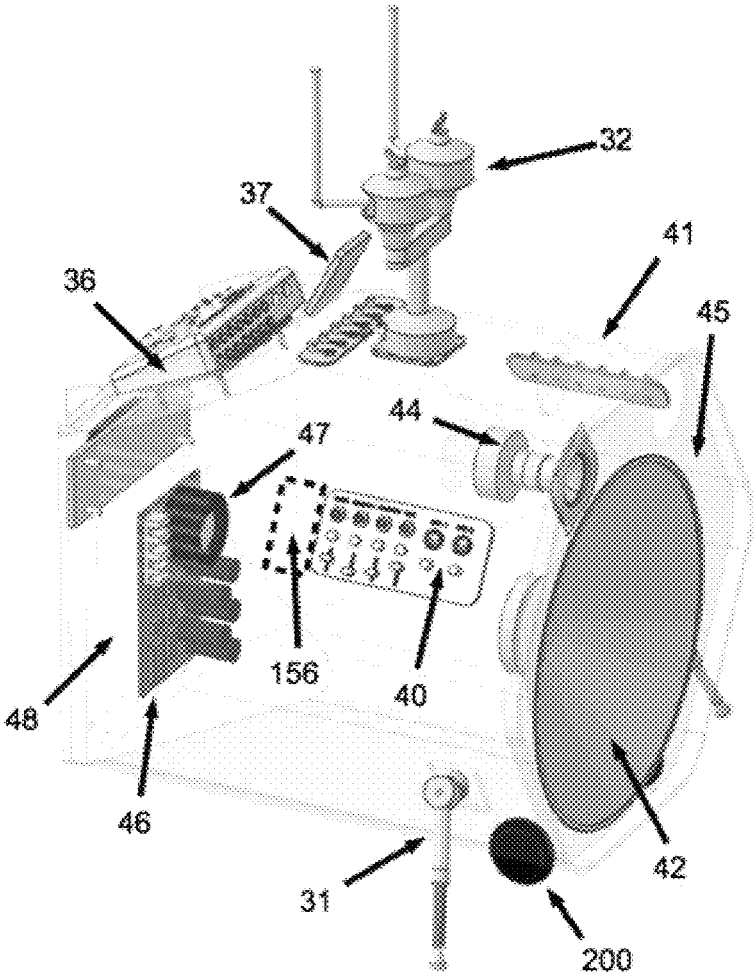
FIG. 5 is a cutaway view showing the internal components of the apparatus according to an embodiment of the present invention.

FIG. 5 is a cutaway view of the internal parts of the instrument, and shows how several previously separate components can be combined into a single instrument. The internal amplifier 46 is mounted to a rear wall 48. There is an optional internal cooling fan 47 that circulates air throughout the invention, in order to prevent the overheating of the internal electronics. There is more than adequate room for an array of speakers 42, 44 mounted on the forward wall 45. An input panel 40 allows several drummers to plug into and play through the invention, using an internal mixer 156.

Figure 6:
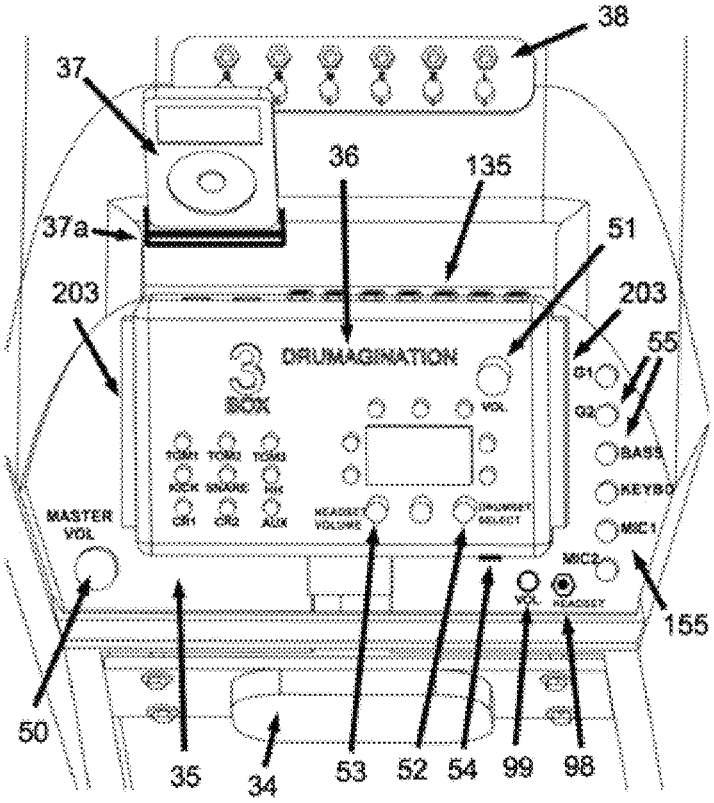
FIG. 6 shows the electronic controls and external components from the top rear of the invention in accordance with a disclosed embodiment.

FIG. 6 shows a close-up of an exemplary main control panel 35 for the internal amplifier and the drum module 36. Note that this is but one possible arrangement, and there are several ways to set up the controls. All critical control functions are easily within reach, starting with the master amplifier volume control knob 50. The drum set select knob 52 enables the performer to quickly change the tonal quality of the externally mounted kick pad 34 as well as all other electronic percussion instruments plugged into the drum module 36 using the module input jacks 135. The module output volume control knob 51 is used to vary the output level of the sounds sent from the drum module to the amplifier or internal mixer. If several musicians were plugged into the invention using the auxiliary input panel and the drum sound level was too high for the group, this control would be used to lessen the sound level of the drums only.

Since most drummers use recorded music to practice with, there is included an MP3 player dock 37*a* which holds a removable MP3 player 37. The output from the MP3 player can be heard through the drummer's headphone mixer jack 98. The drummer may choose to monitor the entire band using the headphone mixer jack 98 and the associated volume control 99, or just monitor the drum module using the module only headphone jack 54 and volume control 53.

There is an internal mixer that is used to balance the sound levels of all the instruments connected to the invention, and the relative volume for all of the accompanying inputs can be controlled by the drummer using the external mixing controls 55 located on the internal mixer control panel 155. Note that all instrument volume levels can be changed quickly and easily, and in many cases levels will be adjusted during live play. The schematic is shown in FIG. 11*a*.

In some embodiments, the module rests on shock-dampening foam pads 203. These items are part of a module shock mount system which will be described below.

Figure 7:
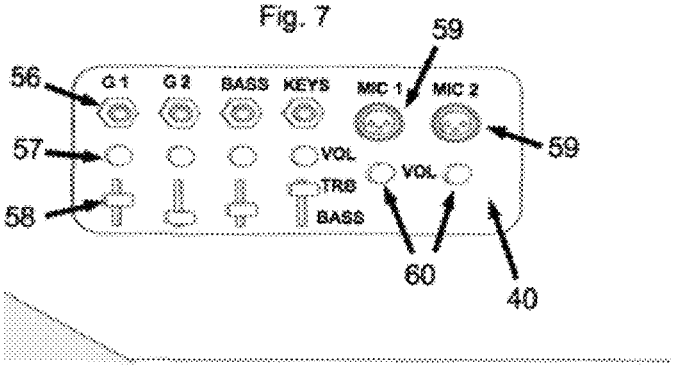
FIG. 7 shows the auxiliary instrument input panel on the right side of the instrument.

FIG. 7 shows the right side of the instrument where the external input jack panel 40 could be located. There is depicted a row of external input jacks 56 for other band members to plug in their electric instruments, and each input has a volume control 57 and an equalizer control 58. Two input jacks for microphones 59 are also shown, with their respective volume control knobs 60. The number of inputs may vary. The schematic is presented in FIG. 11*a*.

Figure 8:
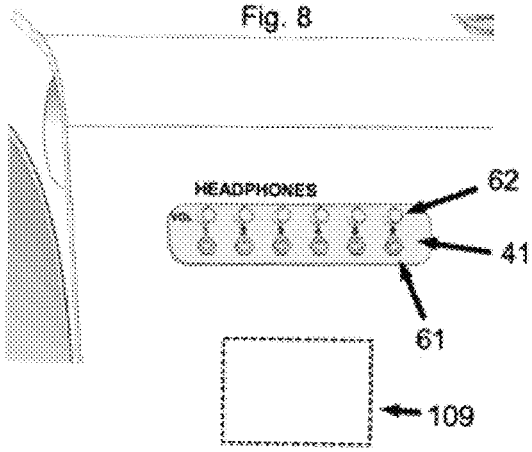
FIG. 8 shows the headphone jack panel as viewed from the left side of the invention.

FIG. 8 shows the left side of an embodiment of the invention where the headphones panel 41 could be located. There is depicted a row of headphone jacks 61 with each jack having its respective volume control 62. The number of jacks and volume controls may vary. There is an internal headphone mixer 109 which allows several musicians to listen to any or all of the inputs to the instrument, which may include a drum module, the MP3 player, and every musician or singer who is plugged into the previously discussed input panel in FIG. 7. The purpose for this arrangement is to allow an entire band to rehearse together in situations where noise output from instruments or amplifiers is not allowed, wherein every player can hear all other players simultaneously, while also listening to an MP3 player song if desired.

Figure 9:
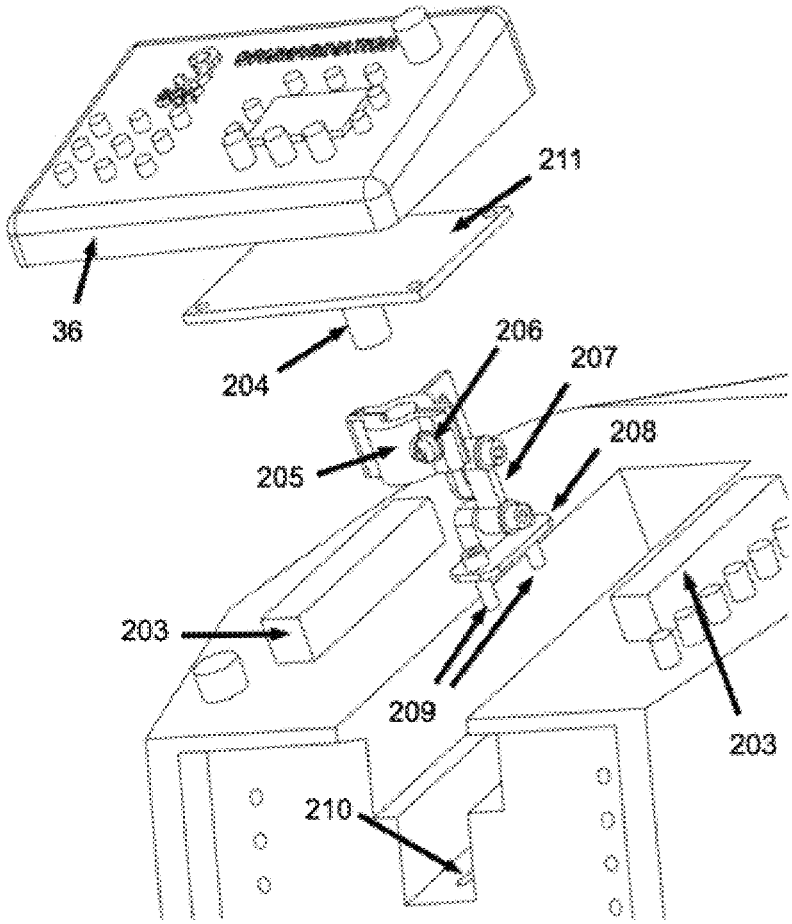
FIG. 9 shows a right rear exploded view of a shock absorbing mount system.

The drum module can be bolted directly to the outside of the shell. However, this may subject the drum module to unwanted vibrations. FIG. 9 shows an exploded view of one embodiment of my shock dampening removable drum module mounting apparatus.

Commercial drum modules are typically attached to rack clamps using either built-in mounting pipes or universal bolt-on brackets 211 that have a mounting pipe 204 attached. In an embodiment of the present invention, the pipe 204 fits into the mounting clamp assembly 205 and is secured using a tightening screw 206. A dog-bone linkage device 207 is pivotally attached on one end to the mounting clamp assembly 205 and is pivotally attached to the clamp base 208 on the other end. The dog-bone linkage device may be made of rubber or a solid material. The clamp base assembly 208 is bolted into the drum shell adjustment track 210 using attachment bolts 209. Note that the adjustment track 210 is long enough to accept any drum module regardless of size. This mounting device holds the module loosely in place, and most of the weight is supported by the shock absorbing pads 203. These pads 203 can be made out of foam, foam rubber, springs, or other shock absorptive materials.

Figure 10A:
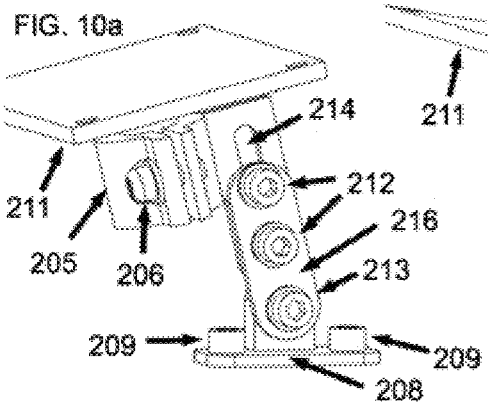
FIGS. 10*a* and 10*b* show left and right side views of a shock absorbing module mount, respectively.
Figure 10B:
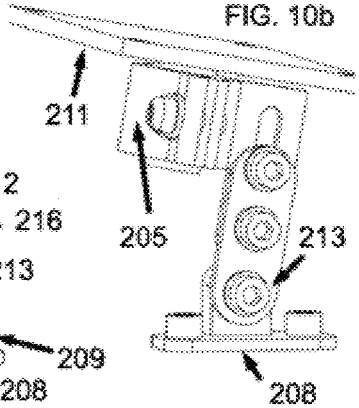
Figure 10C:
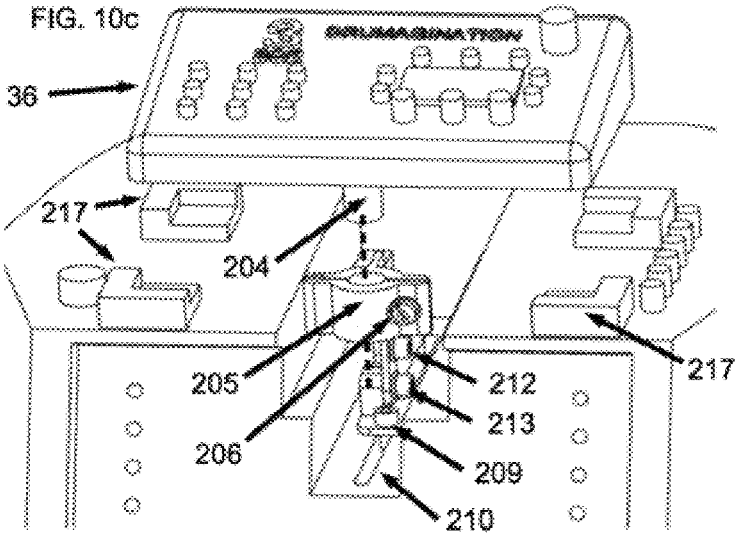
FIG. 10*c* is a rear view of a shock absorbing module mount.

FIGS. 10*a*, 10*b* and 10*c* show another embodiment with a rigid linkage device 216 that connects the clamp base assembly 208 and the mounting clamp assembly 205. The height of the entire bracket is adjustable using adjustment bolts 212 that bolt into a track 214 on the clamp assembly. In this embodiment, the lower attachment bolt 213 is a pivot point, allowing the rigid linkage to pivot, thereby preventing impact vibrations from the drum pedal or loudspeakers from being transferred directly to the electronic drum module. Again, the weight of the unit is primarily supported by the shock absorbing pads, depicted in FIG. 10*c* as corner foam units 217 attached to the shell with adhesive.

Figure 11:
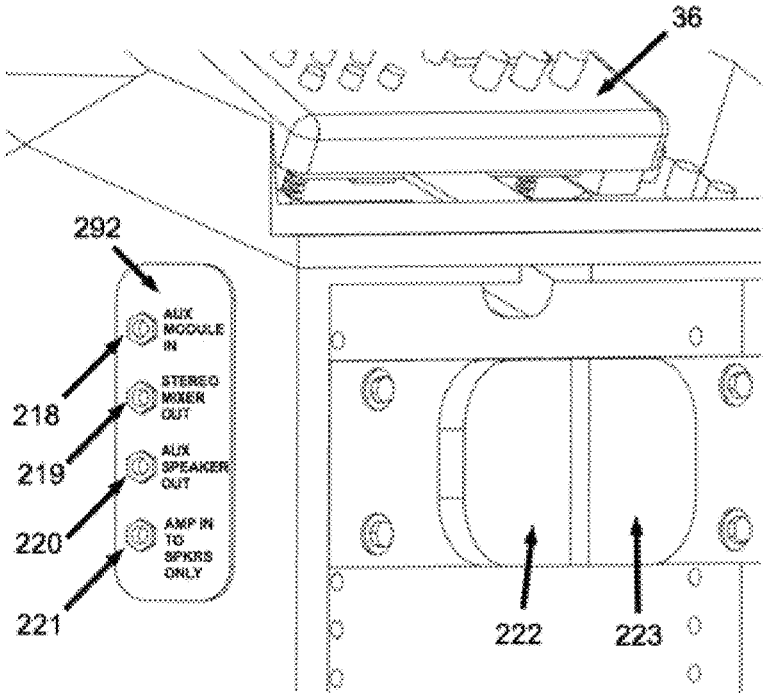
FIG. 11 is a left rear view of an auxiliary panel.
Figure 11A:
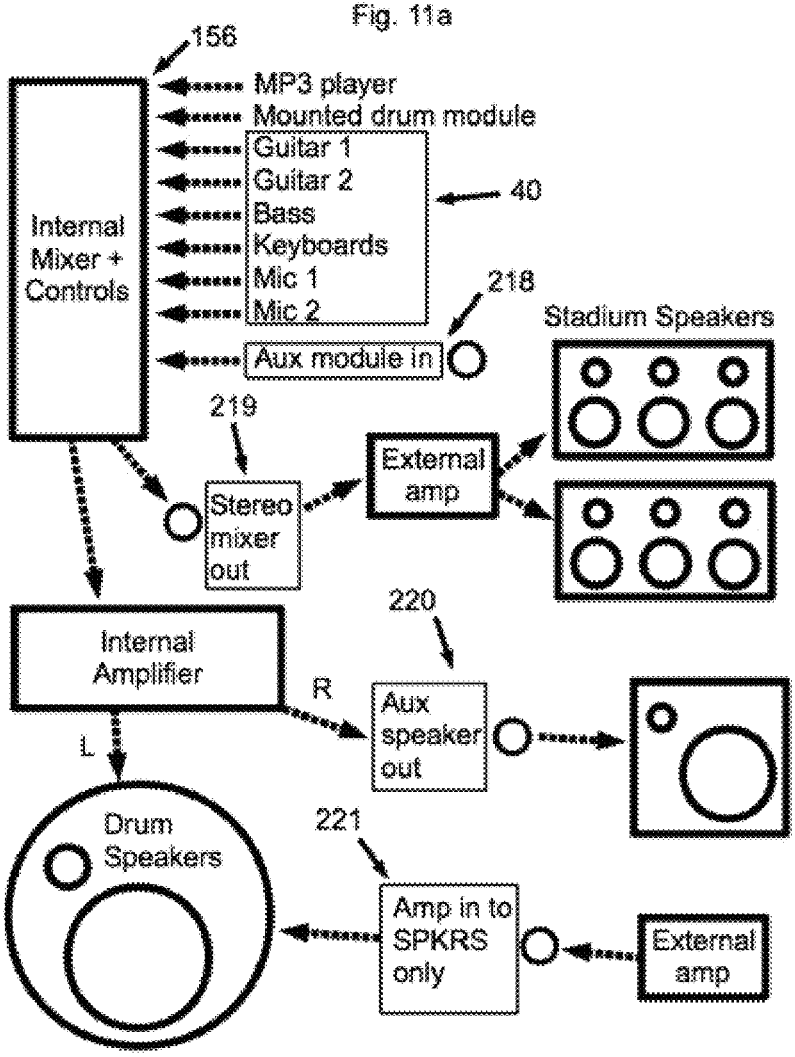
FIG. 11*a* is a schematic of internal electrical connections and auxiliary jacks.

An auxiliary jack panel 292 is shown in FIG. 11, and a corresponding schematic is presented in FIG. 11*a*. Some drummers may want more electronic drum instruments than one module can accommodate. An auxiliary module input jack 218 allows a secondary module to be mixed with the mounted drum module 36 and routed to the amplifier.

Figure 1:
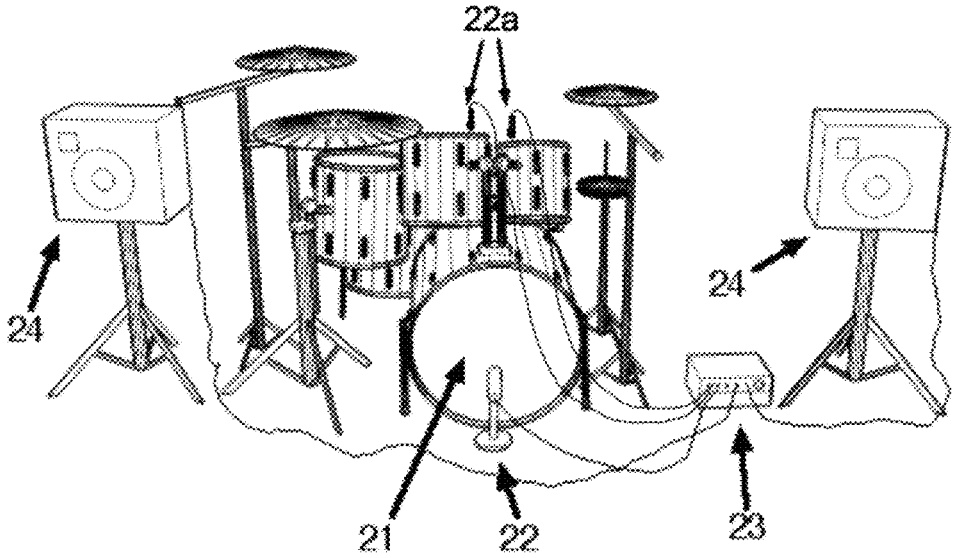
FIG. 1 Prior Art
FIG. 1 shows a conventional acoustic drum configuration using current technology, as viewed from the front.
Figure 1A:
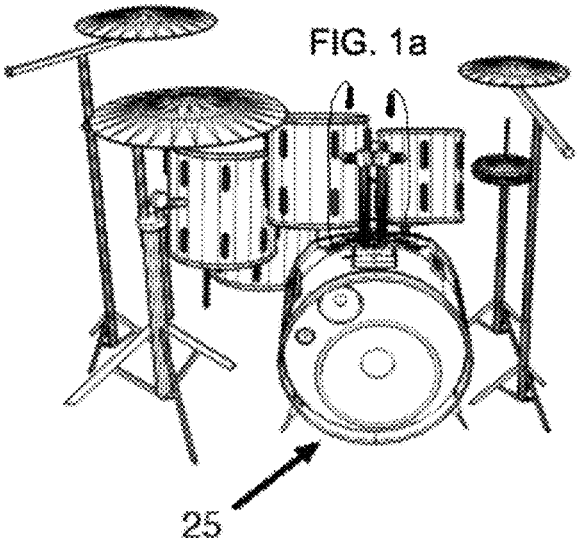
FIG. 1*a* shows the same drum set with components replaced by embodiments of the present invention.
Figure 2:
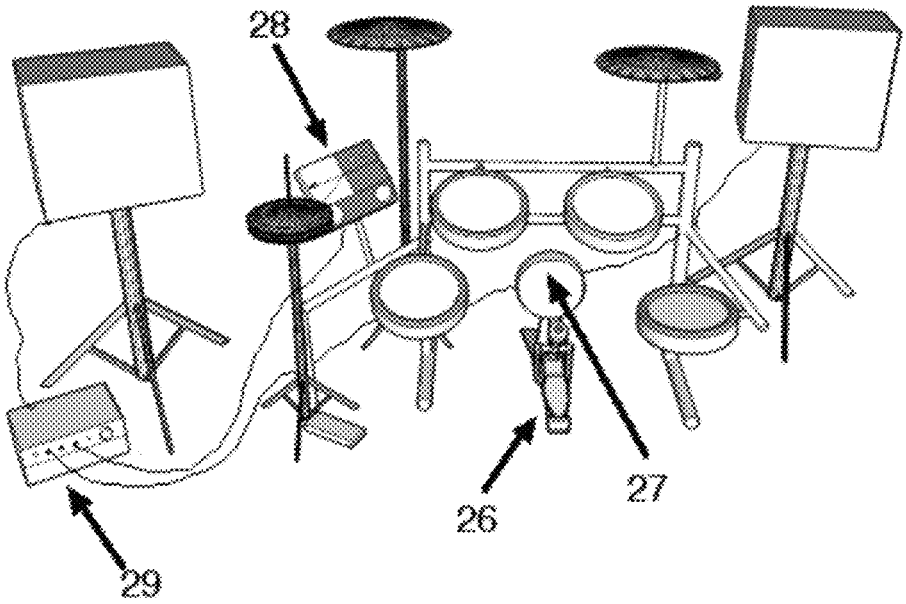
FIG. 2 Prior Art
FIG. 2 shows a conventional electronic drum set using current technology, as viewed from the rear.
Figure 2A:
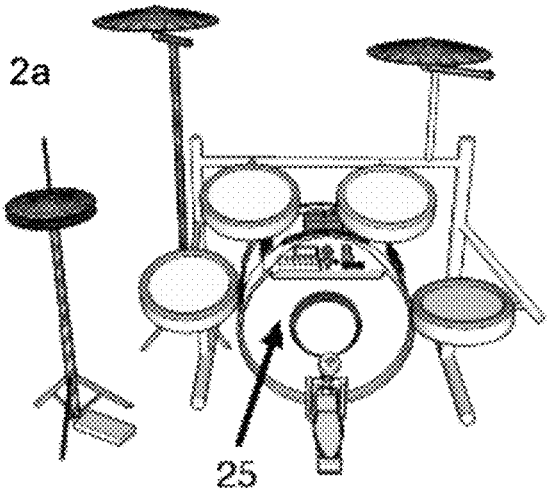
FIG. 2*a* shows the same electronic drum set with components replaced by embodiments of the present the invention.
Figure 2B:
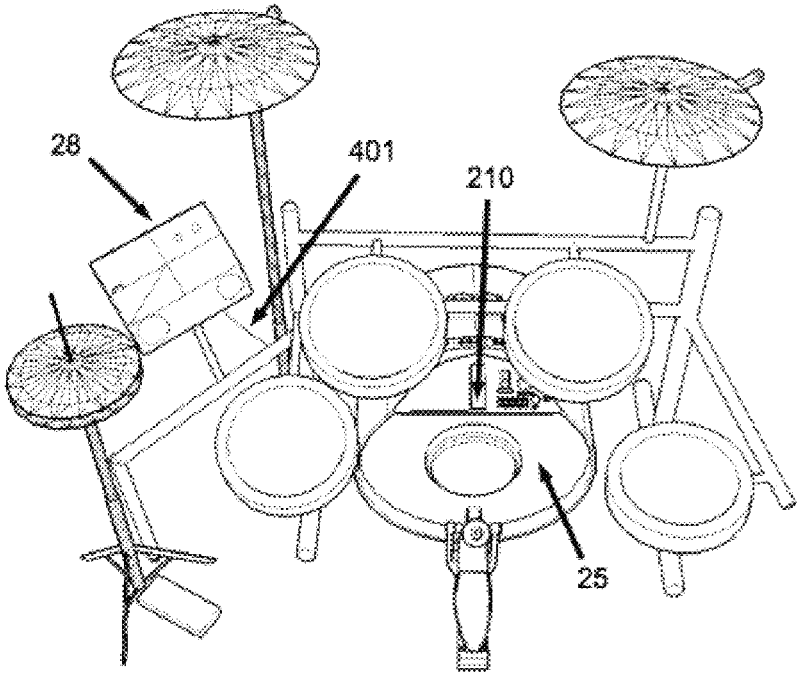
FIG. 2*b* shows the invention in use with a remotely mounted drum module.

There are drummers that will want to keep their drum modules in the original location that was designed into their existing electronic drum kits. FIG. 2*b* shows such a conventional kit which has a drum module 28 mounted on the left side of the kit. Note that the drum shell track 210 has all module mounting devices removed. An electrical cable 401 allows the output of the drum module 28 to connect to the internal mixer and amplifier through the input jack 218 of FIG. 11.

The stereo mixer output jack 219 is used for connecting an external amplifier in situations where the internal amplifier and speakers of the invention are not powerful enough to be heard by an entire audience, such as at a stadium concert for example. This signal could then conceivably be routed to a huge external amplifier, and a massive wall of speakers could fill the stadium with sound.

For most applications, a single channel is used to drive the internal speakers in my invention. However, most drum modules and amplifiers have stereo outputs. The auxiliary speaker output jack 220 is used to power a second speaker channel using the internal amplifier.

The auxiliary speaker output jack 220 takes an amplifier signal from an external amplifier and routes it directly to the internal speakers at the front of my invention. This would come in handy in the event of an internal amplifier failure.

Note that in FIG. 11, two electronic drum kick pads 222, 223 are depicted. This allows drummers who use double pedals to have different sounds triggered by the two pads.

In some instances, connecting electronic drum instruments directly to the back of the shock-mounted drum module would put wires in the drummer's way or be unsightly. My invention includes internal extension cables depicted in FIG. 12. An instrument can be plugged into a jack 224 mounted on the outside of the shell 227, and the extension wire 225 runs inside of the shell and ends at a plug 226 near the back of the module mount.

Figure 12:
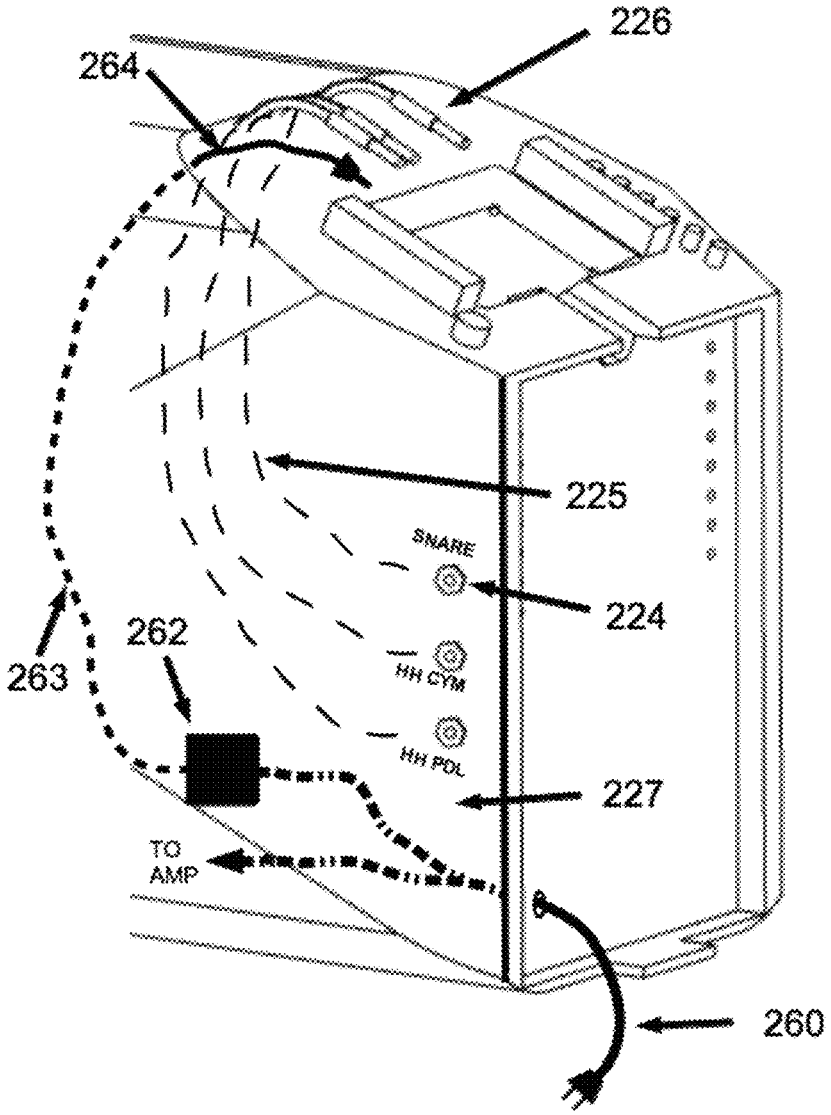
FIG. 12 is a left rear view of internal extension cables.

Lots of electrical wiring clutter can be hidden inside the shell of the drum as well. In FIG. 12, an electrical power cord 260 runs inside of the drum and is split to power the internal amp and the internally mounted drum module power supply brick 262. A low voltage output is then delivered to the module power plug 264 using an internal power supply line 263.

Figure 13:
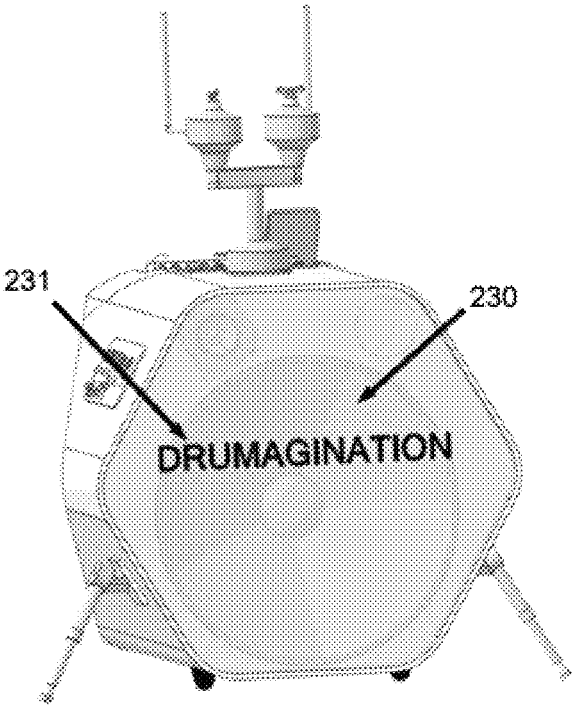
FIG. 13 is a front view of a speaker cover.

In order to protect the loudspeakers at the front of the instrument from dust, debris or physical damage, a cover 230 is depicted in FIG. 13. This cover could be made out of speaker cloth or other loosely woven material, to allow the sound produced by the speakers to fully project to the audience. Note that a band name or other logo 231 could be written on the cover.

Figure 14A:
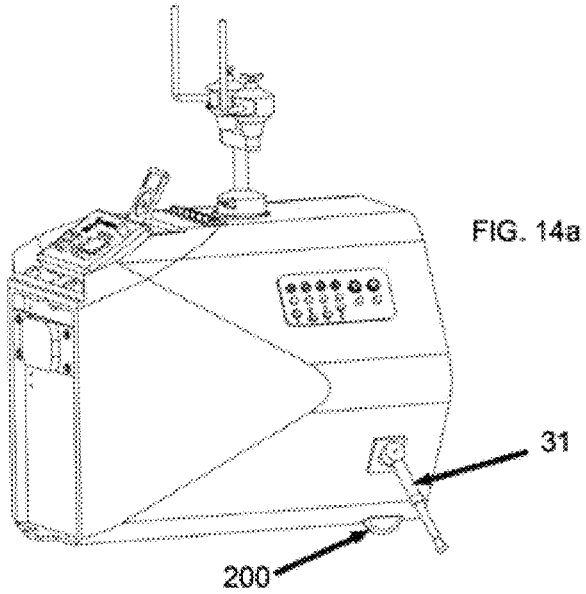
FIG. 14*a* is a side view of the instrument while it is being played.
Figure 14B:
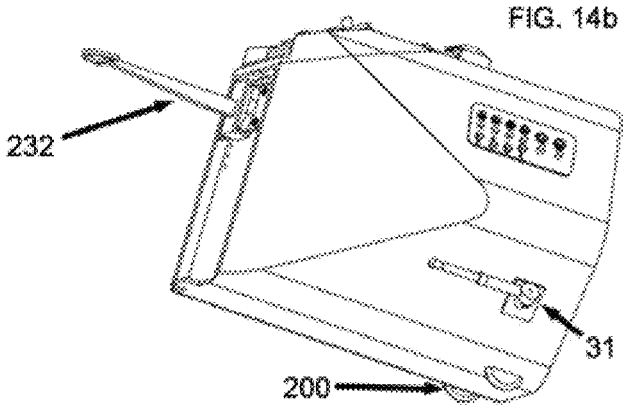
FIG. 14*b* is a side view of the instrument while it is being transported.

An easy transport system has been incorporated into my invention. In FIG. 14*a*, the drum is set up to perform, and the extendable legs 31 lift the transport wheels 200 off of the ground. When the legs 31 are retracted as in FIG. 14*b*, the front of the instrument rests on the transport wheels. A handle 232 is attached and the drum is ready to roll.

Note that the previously disclosed electronic bass drum has a shell that is constructed using an outer shell that may or may not match the shape or finish of conventional acoustic drum sets. Some drummers may want an electronic bass drum that matches their existing sets, and in that light, an acoustic-to-electronic bass drum conversion kit in accordance with disclosed embodiments is provided. In some embodiments, the conversion kit comprises front and rear panels that attach using tension rods and hooks that are identical to acoustic drums. My conversion kit allows drummers or manufacturers to use their existing cylindrical bass drum shells to construct portable electronic amplifier systems. Many features described above have been omitted for clarity, but may be present in my conversion kit.

Figure 15A:
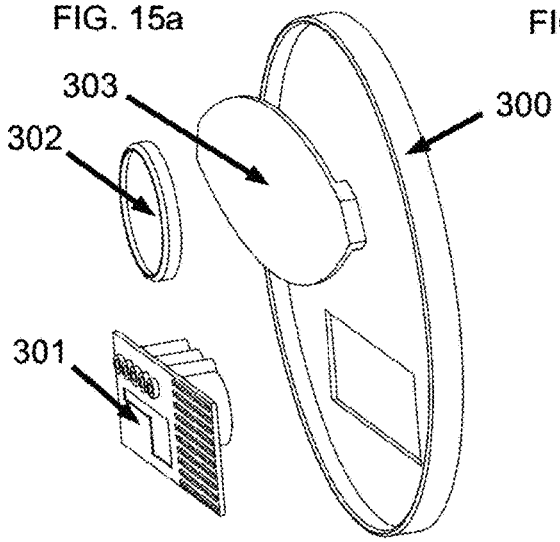
FIG. 15*a* is a side view of components of a front plate of a conversion kit in accordance with the present invention.
Figure 15B:
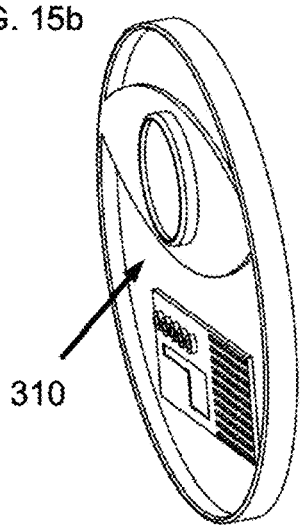
FIG. 15*b* is a side view of the assembled front plate.

My conversion kit comprises two separate panel assemblies; one attaches to the rear of the drum shell (closest to the drummer) and the other to the front of the drum shell. FIG. 15*a* shows the exploded view of a rear panel assembly in accordance with a disclosed embodiment, including the amplifier 301, the impact sensitive drum trigger pad 302 attached to an optional impact dampening device 303 which is made of flexible material; all mounted on a rear panel 300. FIG. 15*b* shows the assembled rear panel assembly 310.

Figure 16A:
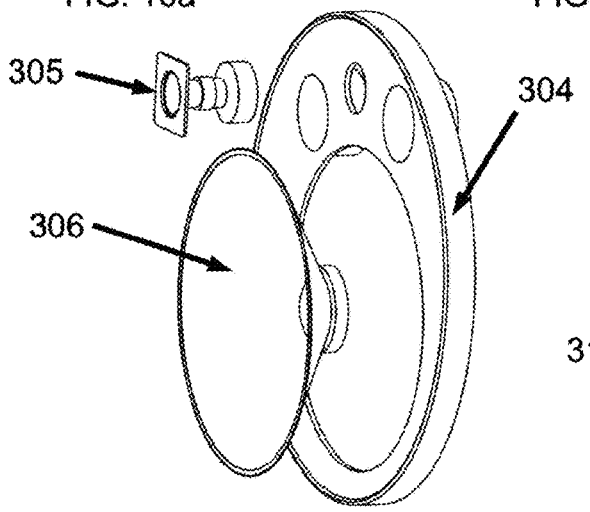
FIG. 16*a* is a side view of the components of the rear plate.
Figure 16B:
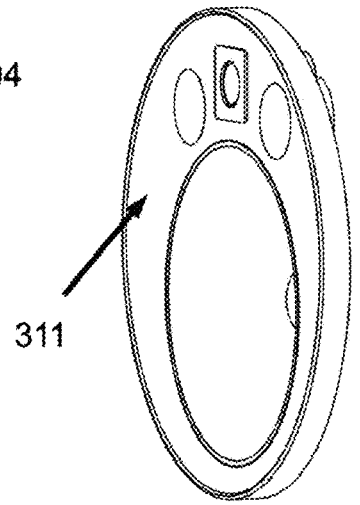
FIG. 16*b* is a side view of the assembled rear plate.

The exploded view of a front panel assembly in accordance with a disclosed embodiment is shown in FIG. 16*a*, and includes one or more speaker units, e.g. which may include a tweeter 305 and a woofer 306, mounted on the front panel 304 to form the completed front panel assembly 311.

Figure 17A:
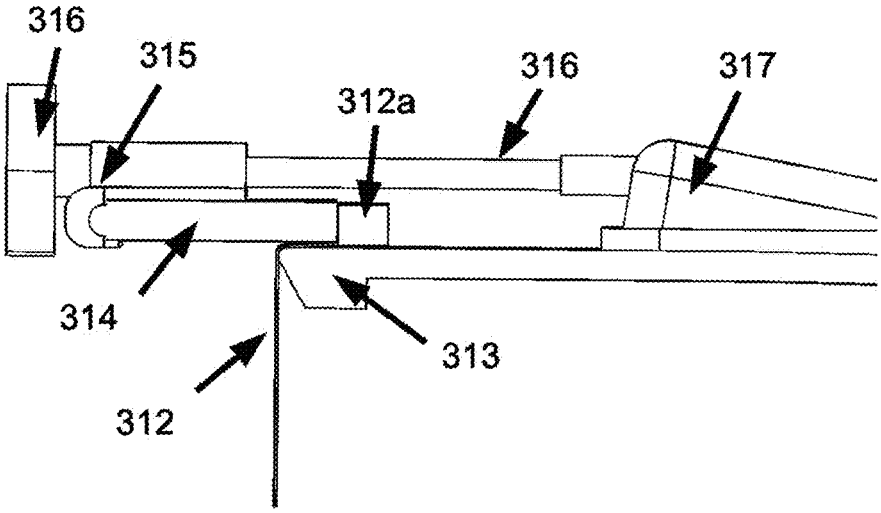
FIG. 17*a* is a cutaway side view of a conventional drum head mounted on an acoustic shell.

FIG. 17*a* is a cross section of a typical acoustic bass drum head tensioning system. The batter head 312 and bead 312*a* are placed over the drum shell 313, and a hoop 314 is placed over the bead 312*a*. Claw brackets 315 are placed on the hoop in several evenly spaced positions around the drum, and handled screw rods 316 are fed through the claws 315 and threaded into drum lugs 317. As the rods are tightened, the tension of the batter head increases.

My invention uses many of the same parts to attach the front and rear assembly panels, providing a simple method of construction and at the same time maintaining the look of an acoustic bass drum.

Figure 17B:
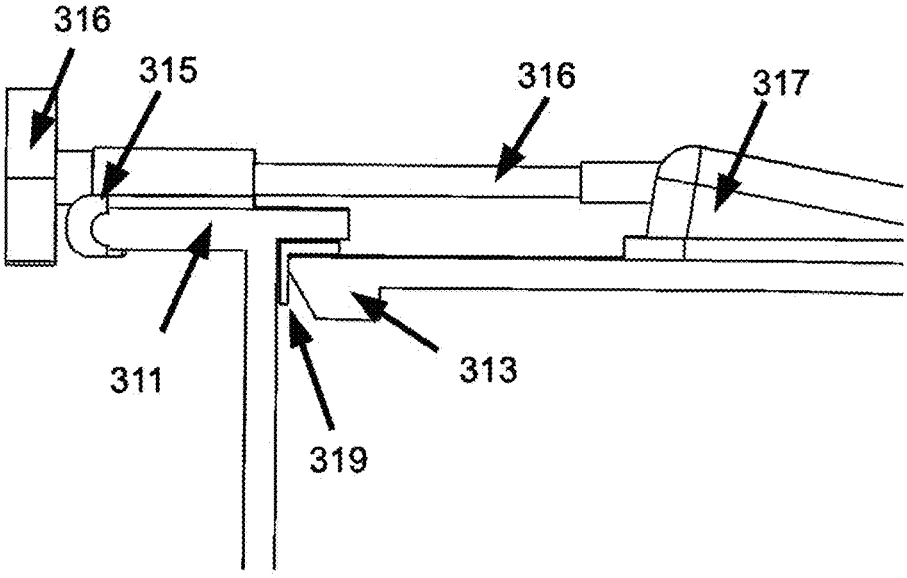
FIG. 17*b* is a cutaway side view of my invention mounted on an acoustic shell.

In FIG. 17*b*, the drum head and bead along with the drum hoop have been removed. The panel assembly 311 has been placed over the drum shell 313, and the hooks 315, tensioning rods 316 and lugs 317 are used to secure the panel to the drum shell. Note that a rim of similar dimensions to a drum hoop is integral to the panel assembly 311. A flexible gasket 319 is used to dampen extraneous vibrations.

Figure 18A:
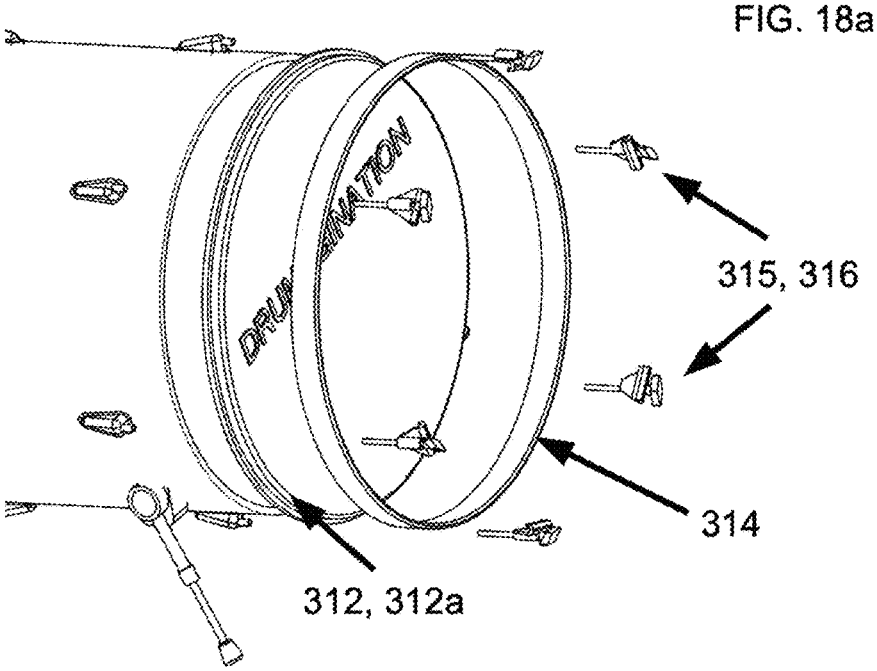
FIG. 18*a* is an exploded front view of an acoustic drum head mounting system.
Figure 18B:
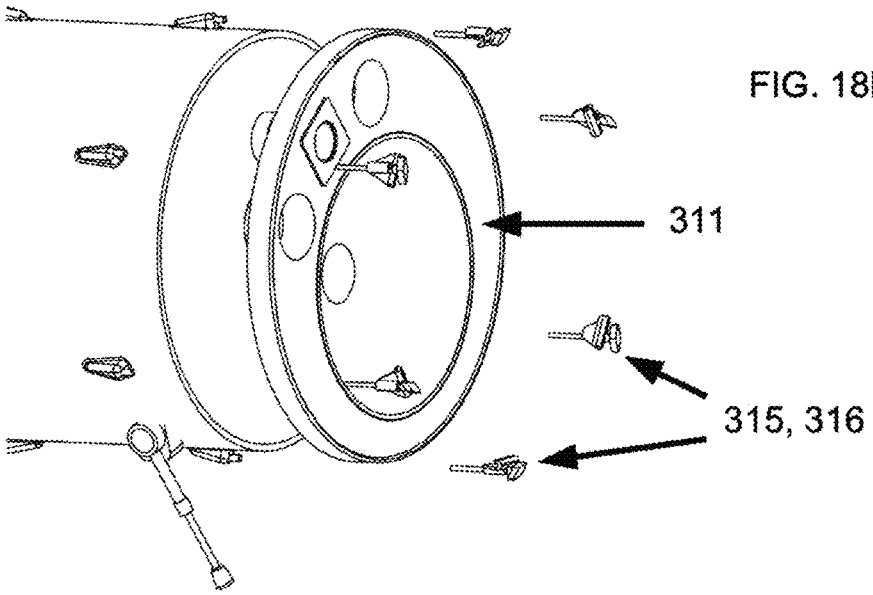
FIG. 18*b* is an exploded front view of my invention using the same mounting system.
Figure 19:
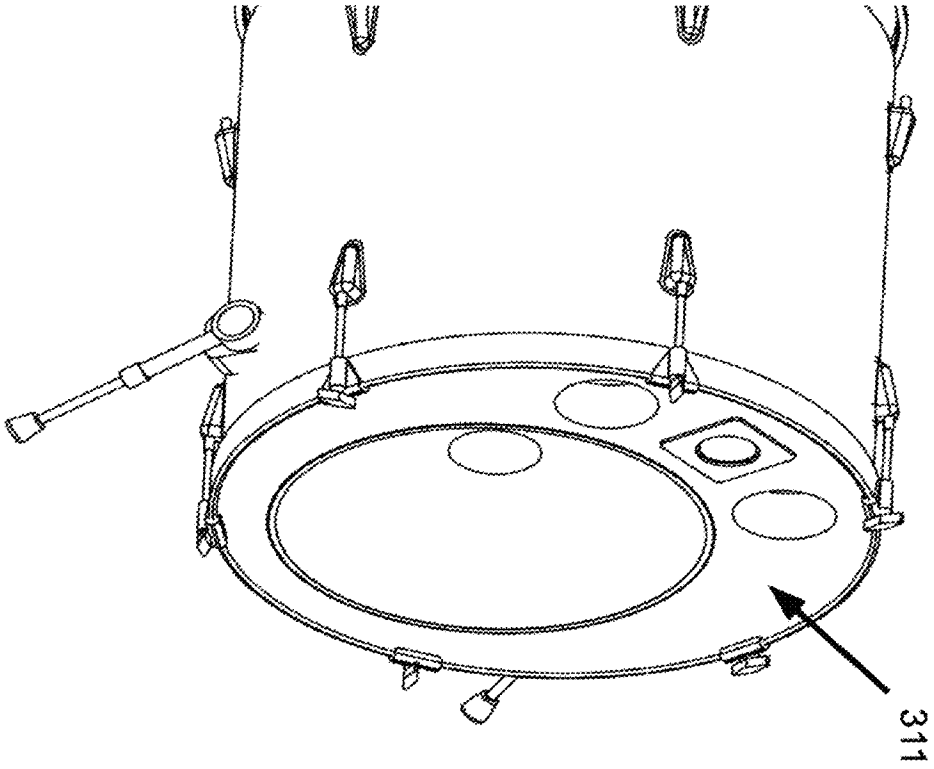
FIG. 19 is a front view of my invention mounted on an acoustic bass drum shell.

FIGS. 18*a* and 18*b* demonstrate an easy conversion process in accordance with an embodiment of the present invention. In FIG. 18*a*, the drum tensioning rods 316 and claws 315 are removed and the hoop 314 and drum head 312/312*a* are discarded. In FIG. 18*b* the front panel assembly 311 is placed over the drum shell and the rods and claws are reattached. FIG. 19 shows an assembled front view of the electronic bass drum including front panel assembly 311.

Figure 20A:
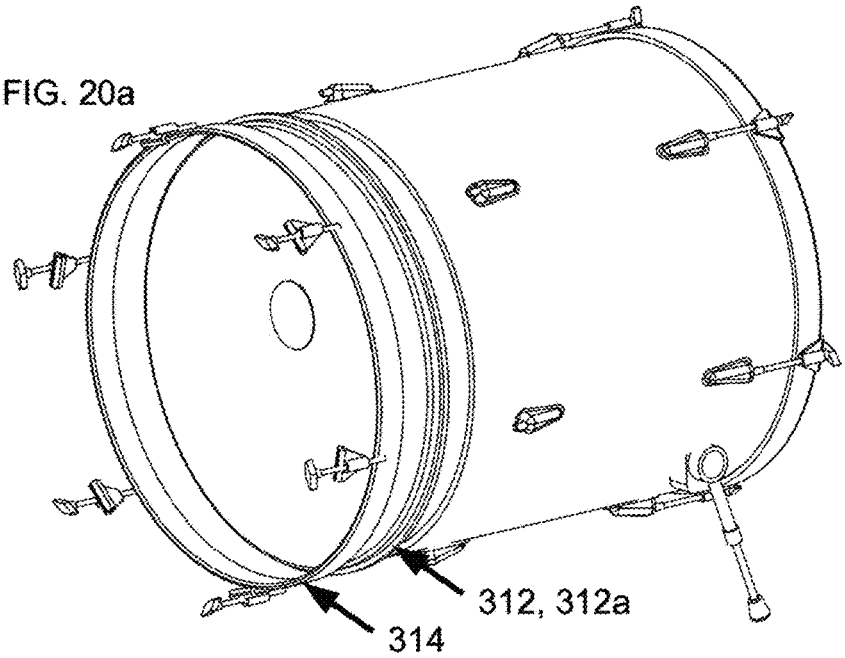
FIG. 20*a* is an exploded rear view of an acoustic drum head mounting system.
Figure 20B:
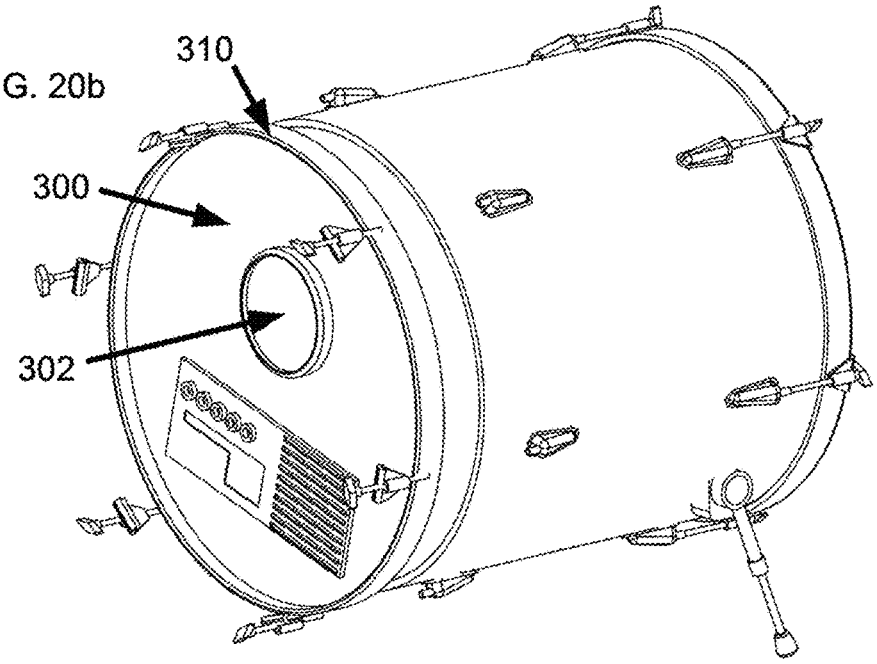
FIG. 20*b* is an exploded rear view of my invention using the same mounting system.
Figure 21A:
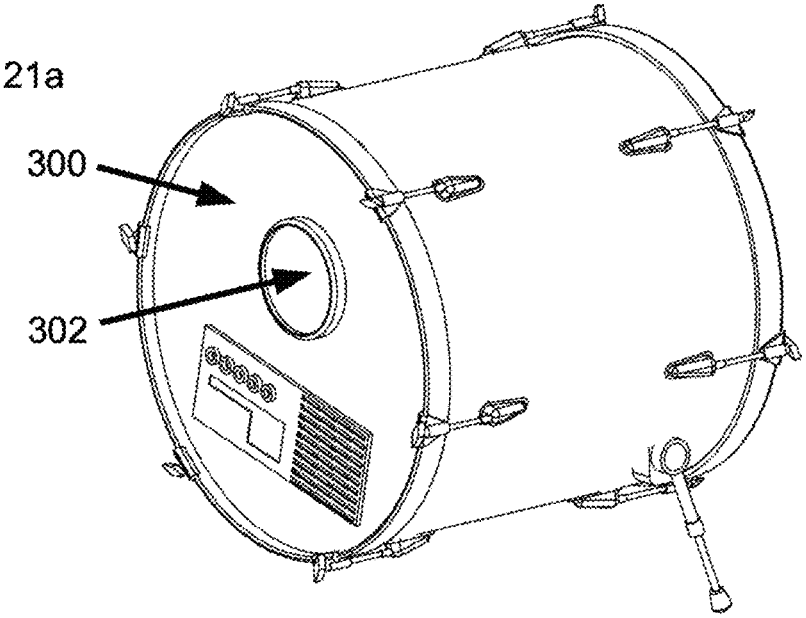
FIG. 21*a* is a rear view of my invention mounted on an acoustic bass drum shell.
Figure 21B:
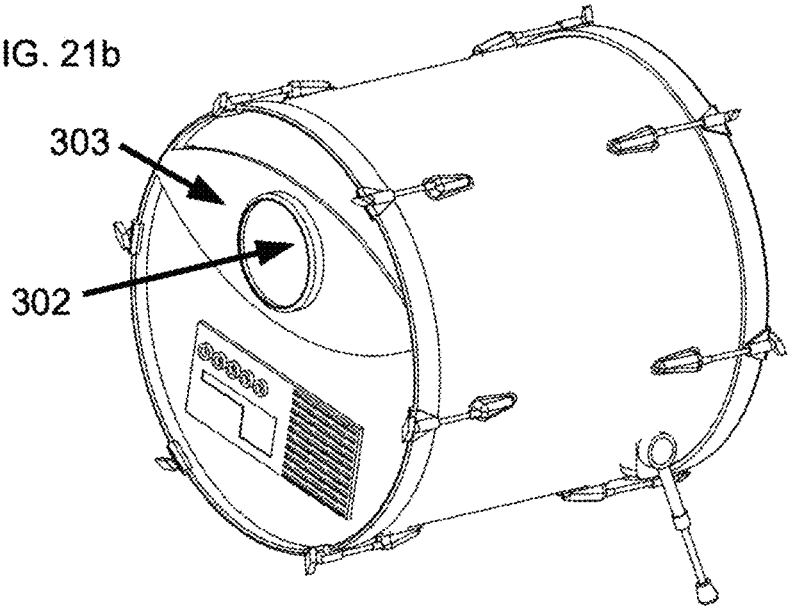
FIG. 21*b* is a rear view of my invention mounted on an acoustic bass drum shell.

FIGS. 20*a* and 20*b* show an exemplary conversion process of the rear of the drum, which is substantially similar or identical to conversion process for the front of the bass drum. The hoop 314 and drumhead 312/312*a* are removed and the rear panel assembly 310 is substituted. The end result can be seen in FIG. 21*a*. Note that in FIG. 21*a*, the impact sensitive drum trigger pad 302 is mounted directly to the rear panel 300, but may also be mounted to an impact dampening device 303 as shown in FIG. 21*b*.

Wires may be utilized to electrically connect the amplifier in the rear panel assembly to the speaker(s) in the front panel assembly.

Figure 22A:
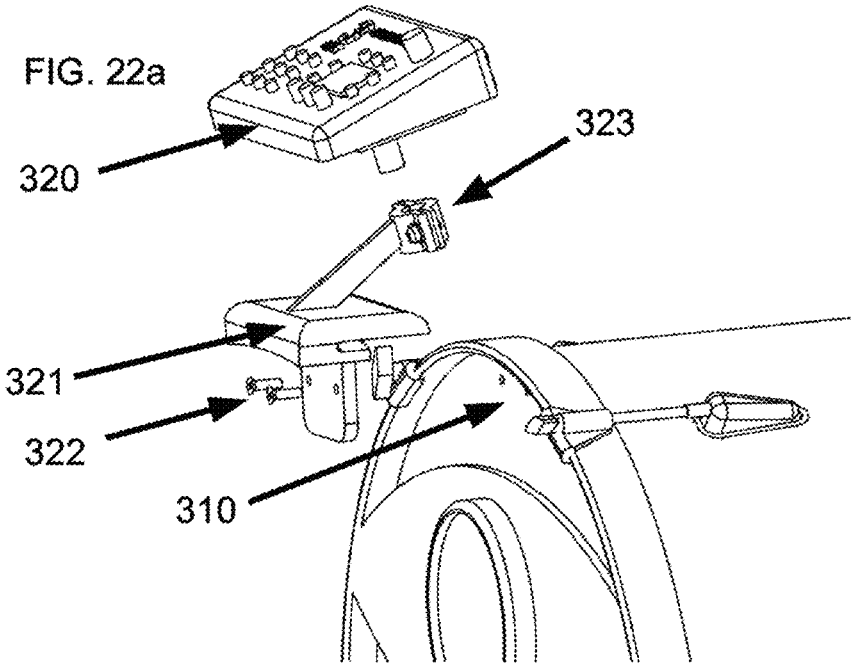
FIG. 22*a* is an exploded rear view of a removable drum module mounting apparatus of a conversion kit in accordance with a disclosed embodiment.
Figure 22B:
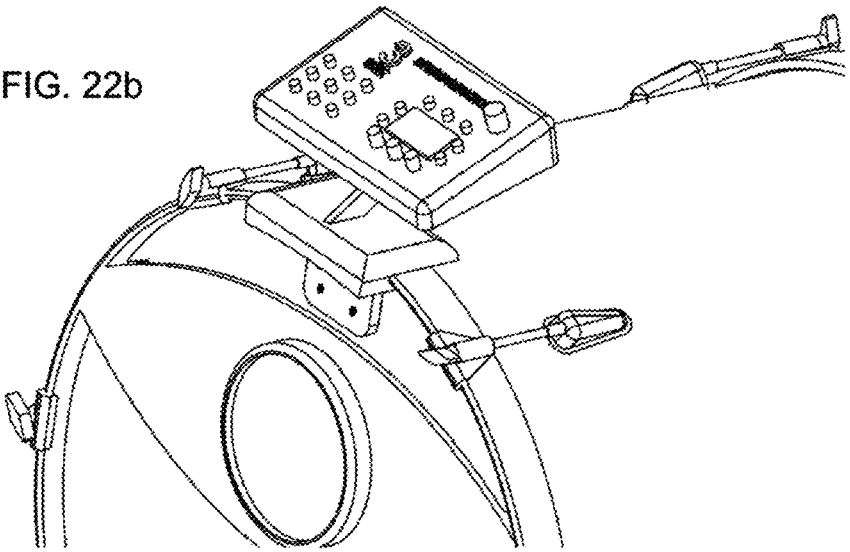
FIG. 22*b* is a rear view of an assembled drum module mounting apparatus of a conversion kit in accordance with a disclosed embodiment.

FIG. 22*a* depicts an exploded view of an optional drum module mounting bracket 321 which attaches directly to the rear panel assembly 310 (e.g., using bolts or screws 322). The module is attached using a clamping device 323 that is part of the bracket. The completed module mounting assembly is shown in FIG. 22*b*.

While the invention has been described in connection with exemplary embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the features hereinbefore set forth. In addition, features and components of one embodiment may be incorporated into other embodiments.

I claim:

1. An acoustic-to-electronic bass drum conversion kit, comprising:

I. a rear panel assembly comprising:

a) a rear panel having an integral rim removably securable to a first end of an acoustic bass drum shell, wherein said integral rim of said rear panel has a diameter substantially equal to or larger than a diameter of said first end of said drum shell;

b) an amplifier mounted on said rear panel; and c) an impact sensitive drum trigger pad attached to said rear panel;

and

II. a front panel assembly comprising:

a) a front panel having an integral rim removably securable to a second end of said drum shell, said second end opposite to said first end, wherein said integral rim of said front panel has a diameter substantially equal to or larger than a diameter of said second end of said drum shell; and b) a speaker unit mounted on said front panel and electrically coupleable to said amplifier;

wherein said rear panel assembly and said front panel assembly are securable to said drum shell via at least one of lugs, tension rods and brackets.

2. The conversion kit of claim 1, wherein said impact sensitive drum trigger pad is mounted to an impact dampening device.

3. The conversion kit of claim 2, wherein said impact dampening device is intermediate said impact sensitive drum trigger pad and said rear panel when said impact sensitive drum trigger paid is secured to said rear panel.

4. The conversion kit of claim 1, further comprising a drum module mounting bracket securable to said rear panel assembly.

5. The conversion kit of claim 4, further comprising a drum module removably securable to said drum module mounting bracket.

6. The conversion kit of claim 1, wherein said speaker unit comprises a tweeter and a woofer.

7. The conversion kit of claim 1, wherein said speaker unit is a first speaker unit, said front panel assembly further comprising at least a second speaker unit securable to said front panel.

8. The conversion kit of claim 1, further comprising an input jack electrically coupled to said amplifier, wherein a first external electronic device is connectable to said input jack and thereby in communication with said amplifier.

9. The conversion kit of claim 8, wherein said input jack is a first input jack, further comprising at least a second input jack electrically coupled to said amplifier, wherein a second external electronic device is connectable to said second input jack and thereby in communication with said amplifier.

10. The conversion kit of claim 1, further comprising an internal cooling fan disposable within an internal cavity of said drum shell.

11. The conversion kit of claim 1, further comprising a bass drum pedal operably associated with said impact sensitive drum trigger pad.

* * * * *